US006435636B1

(12) United States Patent
MacMillan

(10) Patent No.: US 6,435,636 B1
(45) Date of Patent: Aug. 20, 2002

(54) DRAWER SLIDE CUSHION END STOP BUMPER CONSTRUCTION

(75) Inventor: Geoffrey MacMillan, Kitchener (CA)

(73) Assignee: CompX International Inc., Kitchener (CA)

( * ) Notice: Subject to any disclaimer, the term of this patent is extended or adjusted under 35 U.S.C. 154(b) by 0 days.

(21) Appl. No.: 09/667,477

(22) Filed: Sep. 22, 2000

Related U.S. Application Data

(60) Provisional application No. 60/211,580, filed on Jun. 15, 2000.

(51) Int. Cl.[7] ..... A47B 88/00

(52) U.S. Cl. ..... 312/334.46; 312/333; 384/21

(58) Field of Search ..... 312/334.44, 334.46, 312/334.7, 334.1, 333; 384/18, 19, 20, 21

(56) References Cited

U.S. PATENT DOCUMENTS

| | | | | | |
|---|---|---|---|---|---|
| 4,141,525 | A | | 2/1979 | Miller | |
| 4,147,393 | A | | 4/1979 | Nelson et al. | |
| 4,289,290 | A | | 9/1981 | Miller | |
| 4,423,914 | A | | 1/1984 | Vander Ley | |
| 4,469,384 | A | * | 9/1984 | Fler et al. | 312/333 |
| 4,537,450 | A | * | 8/1985 | Baxter | 312/18 |
| 4,549,774 | A | | 10/1985 | Bessinger et al. | |
| 4,605,265 | A | | 8/1986 | Bessinger et al. | |
| 4,932,792 | A | * | 6/1990 | Baxter | 348/18 |
| 4,988,214 | A | | 1/1991 | Clement | |
| 5,181,781 | A | * | 1/1993 | Wojcik | 312/334.44 X |
| 5,181,782 | A | * | 1/1993 | Wojcik | 312/334.44 X |
| 5,255,983 | A | | 10/1993 | Parvin | |
| 5,316,389 | A | | 5/1994 | Hoffman | |
| 5,403,097 | A | | 4/1995 | Woof | |
| 5,411,333 | A | * | 5/1995 | Hoffman | 348/18 |
| 5,466,060 | A | | 11/1995 | Hoffman | |
| 5,472,272 | A | | 12/1995 | Hoffman | |
| 5,507,571 | A | | 4/1996 | Hoffman | |
| 5,551,775 | A | | 9/1996 | Parvin | |
| 5,671,988 | A | | 9/1997 | O'Neill | |
| 5,695,265 | A | | 12/1997 | Hoffman | |
| 5,730,514 | A | | 3/1998 | Hashemi | |
| 5,757,109 | A | | 5/1998 | Parvin | |
| 5,868,479 | A | | 2/1999 | Hoffman | |
| 5,871,265 | A | | 2/1999 | Stewart et al. | |
| 6,033,047 | A | | 3/2000 | Hoffman | |
| 6,126,255 | A | * | 10/2000 | Yang | 312/334.46 |
| 6,145,945 | A | * | 11/2000 | Parvin | 312/334.46 |
| 6,155,661 | A | * | 12/2000 | O'Neil et al. | 312/334.44 |
| 6,244,678 | B1 | * | 6/2001 | Dopp et al. | 312/334.44 X |

FOREIGN PATENT DOCUMENTS

| | | | | |
|---|---|---|---|---|
| CA | 2210280 | | 1/1998 | |
| DE | 4410340 | * | 10/1994 | 312/334.44 |
| DE | 4315518 A1 | | 11/1994 | |
| DE | 4411921 A1 | | 10/1995 | |
| DE | 29701895 | | 4/1997 | |
| GB | 2081071 | * | 2/1982 | 312/333 |
| WO | WO9847410 | | 10/1998 | |

* cited by examiner

*Primary Examiner*—Lanna Mai
*Assistant Examiner*—Hanh V. Tran
(74) *Attorney, Agent, or Firm*—Banner & Witcoff, Ltd.

(57) ABSTRACT

A cushion and stop detent member for a drawer slide includes cushioning arms, a detent projection and a frictional ramp or surface all embodied in a single element positioned to engage telescopic slide members of a drawer slide construction in a manner which cushions the movement of the slide members to the closed position, reduces any rebound, and provides a detent closure retention of the slide in the closed position.

6 Claims, 3 Drawing Sheets

FIG.5
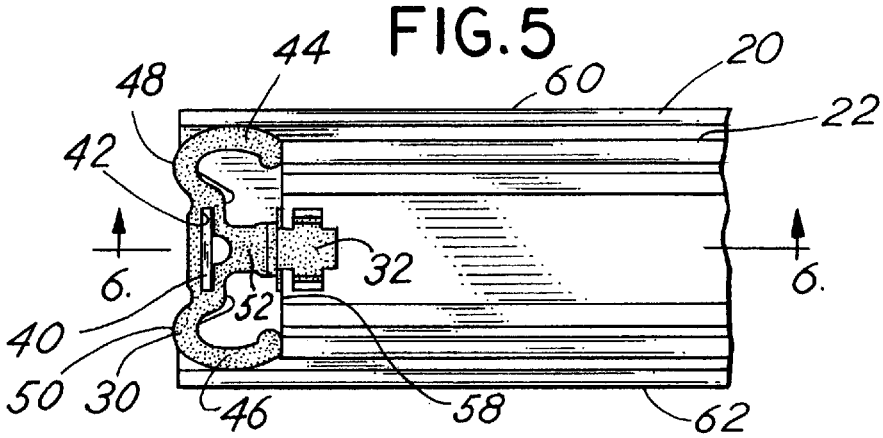
FIG.6
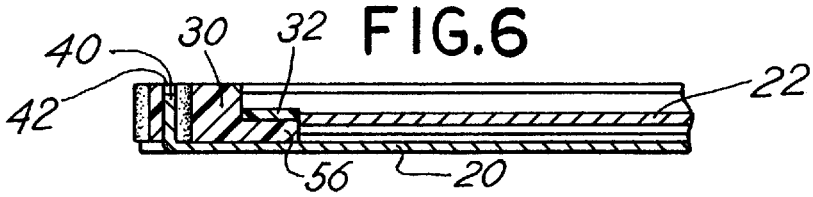
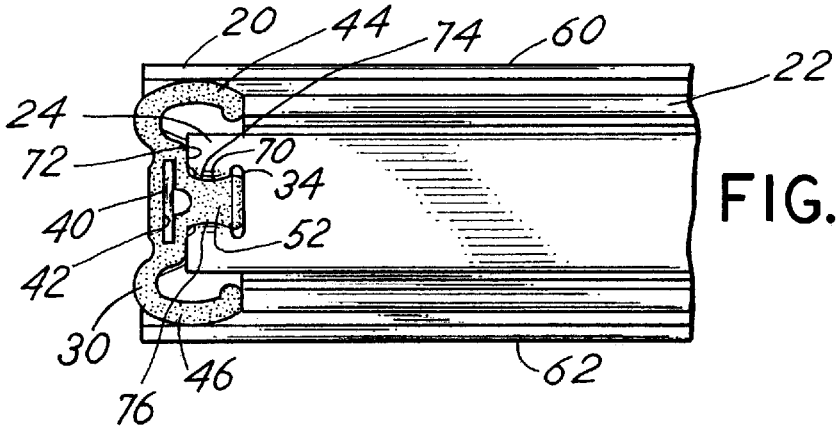
FIG.7
FIG.8
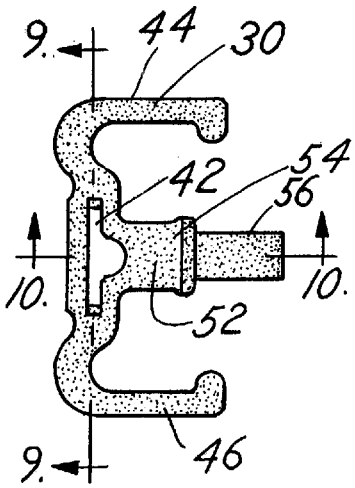
FIG.9
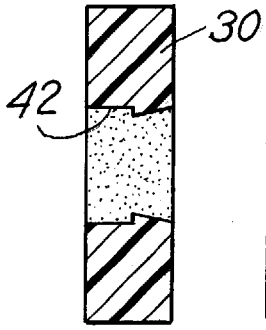
FIG.10
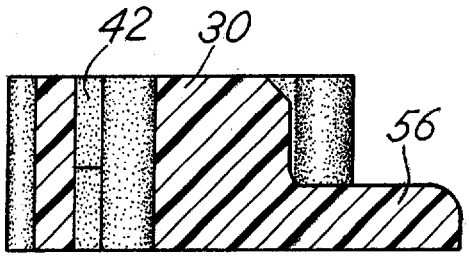

FIG. 11
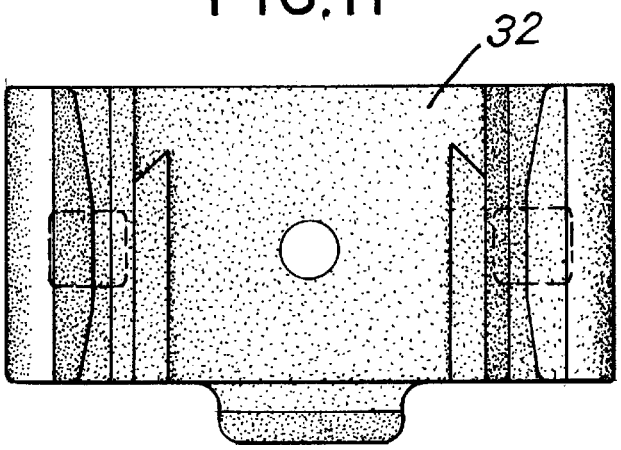
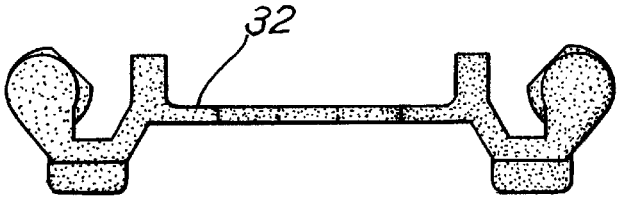
FIG. 12
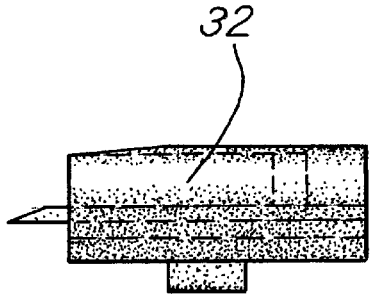
FIG. 13

DRAWER SLIDE CUSHION END STOP BUMPER CONSTRUCTION

CROSS REFERENCE TO RELATED APPLICATION

This is a utility application based upon provisional application Ser. No. 60/211,580, filed Jun. 15, 2000 for Drawer Slide Cushion And Stop Bumper Construction which is incorporated herewith by reference and for which priority is claimed.

BACKGROUND OF THE INVENTION

In a principal aspect the present invention relates to a drawer slide assembly comprised of multiple telescopic channels or slide members. Separate channels of the assembly attach respectively to the side of a drawer and the side of a cabinet and telescope or slide with respect to each other to permit opening of the drawer from the cabinet while supporting the drawer. More particularly, the invention relates to a construction of a bumper and stop construction which is incorporated in a drawer slide assembly of the type described.

Use of drawer slides which are attachable to the inside walls of a cabinet for support of drawers that may be slidably pulled from the cabinet is well known. Typically, slides are constructed of two or more channels which telescopically slide with respect to one another. Normally, the outermost channel has the greatest width dimension and encloses or encompasses the inner sliding channels or slide members. The channels usually include ball bearings in raceways between the separate slides or channels to facilitate the sliding motion of the channels with respect to each other.

Movement of a drawer into and out of a cabinet can result in harsh sounds and rebound unless an appropriate bumper shock absorbing feature is incorporated in the slide assembly. Thus, there is a requirement for an improved slide stop, cushioned bumper construction.

SUMMARY OF THE INVENTION

Briefly, the present invention comprises a drawer slide which includes an outer channel or slide with a telescopically mounted intermediate channel or slide mounted within the outer slide and an inner channel or slide telescopically and slidably mounted within the intermediate channel. A cushion and detent bumper construction made from a resilient material is attached to the inside end of the outer channel and includes projecting legs and a cam surface designed to engage and cushion the movement of the intermediate channel upon sliding movement thereof to the closed position. Further, the cushion construction includes a cam member which frictionally engages and holds the intermediate channel engaged with the outer channel when the intermediate channel is slidably moved to the closed position to thereby eliminate or greatly reduce rebound action. A resilient detent member is formed in the construction to cooperate with a receptor opening in the inner channel which is designed to releasably engage the receptor opening and thus hold the inner channel and an attached drawer in a closed position until the holding force associated therewith is overcome by pulling on the drawer.

Thus, it is an object of the invention to provide an improved slide construction for drawers.

It is a further object of the invention to provide a slide construction for drawers which includes a resilient bumper and stop construction.

Another object of the invention is to provide a drawer slide having a resilient bumper and stop construction which reduces rebound upon closure of the slide.

Another object of the invention is to provide a resilient bumper and stop construction which includes a resilient member that releasably engages and holds the drawer slide assembly in the closed position.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 5 is a plan view of the intermediate and outer channels or slides in the fully closed position;

FIG. 6 is a side sectional view of FIG. 5 taken along the line 6—6;

FIG. 7 is a plan view of the inner channel or slide moved to the fully closed or inner slide position;

FIG. 8 is an elevation of the bumper and stop construction of the invention;

FIG. 9 is a sectional view of FIG. 8 taken along the line 9—9;

FIG. 10 is a sectional view taken along the line 10—10 in FIG. 8;

FIG. 11 is a plan view of the cam follower of the bumper and stop construction;

FIG. 12 is an end elevation of the follower of FIG. 11; and

FIG. 13 is a side elevation of the follower of FIG. 11.

DESCRIPTION OF THE PREFERRED EMBODIMENT

Figure 1:
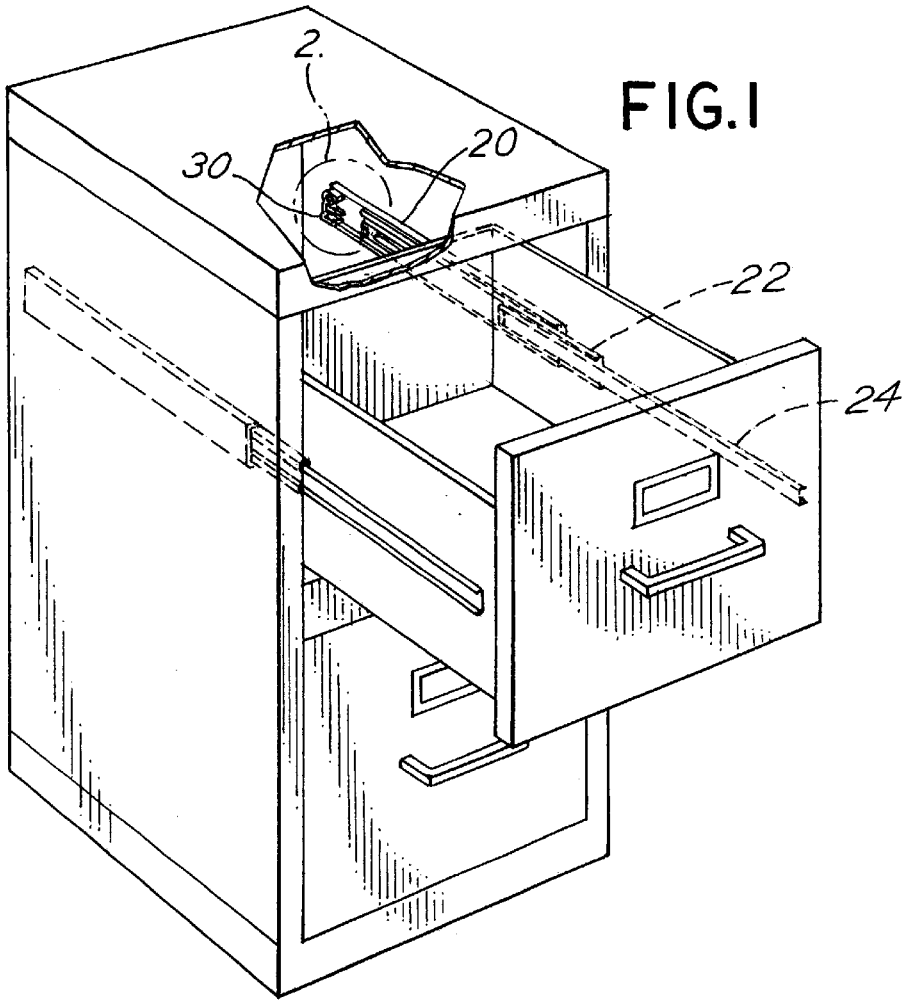
FIG. 1 is an isometric view of slide channels including the bumper and stop construction of the invention incorporated in a cabinet with a drawer.
Figure 2:
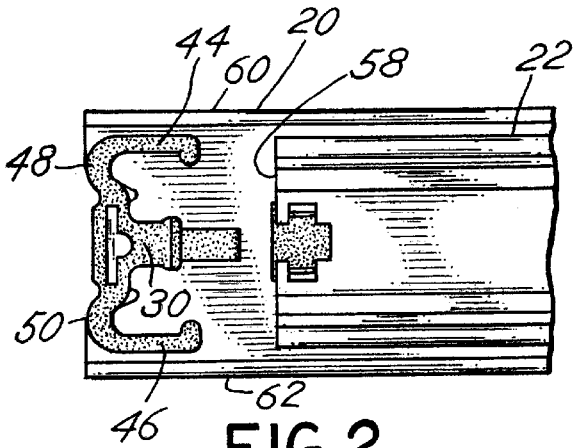
FIG. 2 is a partial plan view of the inside or rear end of the outer channel or slide and the intermediate channel or slide incorporating the bumper and stop construction of the invention.
Figure 3:
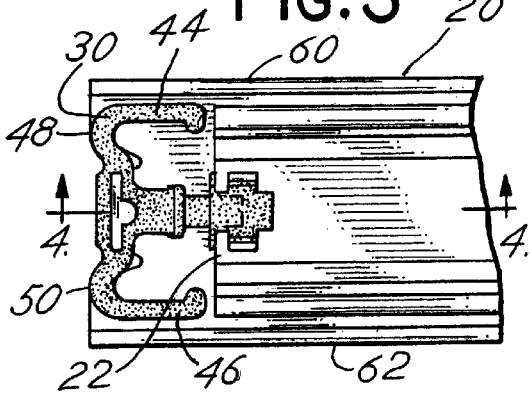
FIG. 3 is a plan view similar to FIG. 2 wherein the channel or slide members have been moved with respect to one another.
Figure 4:
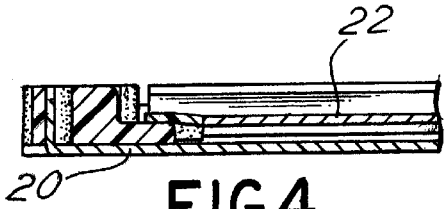
FIG. 4 is a cross sectional view of the construction of FIG. 3 taken along the line 4—4.

Referring to the drawings, the drawer slide construction of the invention is comprised of an outer channel, slide or member 20, an intermediate channel, slide or member 22 and an inner channel, slide or member 24. The outer channel 20 is typically attached to the side wall 16 of a cabinet 18 and the inner channel, slide or member 24 is attached to the side wall 19 of a drawer 21. Typically, one slide assembly is attached on each opposite side of a cabinet 18 enclosure. Each slide assembly then is also attached to one of the opposite sides of a drawer 21 which slides and thus moves into and out of the cabinet 18 in response to manual movement of the drawer 21. Thus, the intermediate channel 22 and the inner channel or slide 24 telescopically slide outwardly from the cabinet 18 enclosure to permit the drawer 21 to be opened. The channels 20, 22 and 24 typically include ball bearings arranged in races intermediate the channels so that the channels 22, 24 may easily slide and telescope with respect to one another.

The subject matter of the invention relates to the construction of a bumper and stop at the inner end of the channels or slides 20, 22, 24 attached to outer channel 20. The purpose or function of such a bumper and stop is to cushion the intermediate and inner channels 22, 24 as they move or slide to the closed position. Further, a function of the bumper and stop construction of the invention is to reduce any rebound action associated with the slides as the drawer 21 is moved to the closed position. Yet another function of the invention is to provide a detent mechanism which engages the inner channel or member 24 and holds it in the closed position until a positive force is imparted on the drawer 21 to remove the drawer 21 from its closed position and thus release the inner channel 24 from a detent lock position.

The various functions described are a result of the construction of a stop end bumper 30 mounted on the inner end of the outer channel 20 taken in combination with a cam follower 32 mounted in the intermediate channel 24 and further in combination with a detent reception opening or passage 34 defined in the inner channel or inner telescopic and sliding member 24. The component parts referenced thus provide the function of cushioning the closure of a drawer 21 and, more particularly, cushioning the movement of the channels 22 and 24 to the closed position. The described components also reduce any rebound effect upon closing of a drawer 21 and, in particular, upon movement of the intermediate channel 22 and inner channel 24 to the closed position. Finally, the construction provides a holding or detent action in combination with the other features whereby the slide assembly and thus the drawer 21 is maintained in the closed position, but may be released by overcoming the detent force.

FIG. 8 depicts the construction of the bumper and stop member which is attached to the outer channel 20. Thus, outer channel 20 includes a transversely or outwardly projecting mounting tab or tang 40 which slidably receives and retains the member 30. Member 30 has an opening molded therein; namely, opening 42 so that the member 30 may fit onto the tab or tang 40. Member 30 is made from a resilient material, such as a plastic material which has elastic characteristics. The member 30 includes a first flexible arm 44 and a second flexible arm 46 spaced from and generally parallel to the first arm 44. The arms 44 and 46 extend in the direction of slide or channel movement. The first and second flexible arms 44 and 46 are connected respectively by hinge sections 48 and 50 to main body section 52 of the member 30. Projecting from the center of the body section or body 52 in the same direction as the flexible arms 44 and 46 is a detent member 54.

The member 30 further includes a planar ramp 56 projecting from the body member 52 in the direction of the detent member 54. The ramp 56 has a limited thickness as depicted in FIG. 6. This is to permit a cam follower 32 which is inserted into the inner end 58 of the intermediate channel 22 to slide over or engage the ramp or follower 56 when the intermediate channel 22 is moved to the closed position as illustrated in FIG. 5. Thus, the follower 32 frictionally engages with the opposed surface of the camming member 56 to frictionally retain the intermediate member or channel as channel 22 is moved to the closed position. This construction also provides the function of reducing any rebound upon closure of the intermediate slide 22.

Upon closure of the slide assembly and movement of the intermediate channel 22 to the closed position, the inner end 58 of the intermediate channel 22 will engage against the flexible arms 44 and 46. This cushions the closure of the intermediate channel 22. Note that the arms 44 and 46 will spread outwardly as they are engaged by the intermediate channel 22 and thus impact against the sides 60 and 62 of the outer channel 20. However, because the arms 44 and 46 are flexible, they provide a continued cushioning effect even though they are constrained within the outer channel 20. The combination of the arms 44 and 46 with the ramp 56 provides a cushioning as well as an anti-rebound effect upon closure of the intermediate channel 22.

The inner channel 24 may slidably move within the intermediate channel 22 to the closed position as illustrated in FIG. 7. When so moved, the inner channel 24 which includes a detent opening or receptor 70 at its inner end 72 will be engaged with and receive the detent 54 of the member 30. The detent 54 thus is elastic and will deform so as to receive opposed side wings 74 and 76 of the receptor or detent opening 70. In this manner, when a drawer is moved to the closed position and all of the sliding elements; namely, channels 22 and 24 are moved to the closed position, the inner channel or slide member 24 which is attached to the drawer will be retained by the detent construction described. A physical force is then required to overcome this closed position. The drawer 21 will then have "feel" with respect to being opened.

The member 30, because of its construction which incorporates arms 44 and 46, as well as detent member 54 and the ramp 56, thus provides a multiplicity of functions associated with closure of the slide assembly and thus closure of a drawer 21 supported by the slide assembly. The specific construction and configuration of the various component parts may be altered without departing from the spirit and scope of the invention. Consequently, the number and shape of the arms 44 and 46 may be altered or varied. The shape and configuration of the ramp 56, as well as the detent member 54, may be altered or varied to accommodate compatible shapes associated with the intermediate channel 22 and outer channel 24. The number of channels may be altered from two or more. Thus the invention is to be limited only by the following claims and equivalents thereof.

What is claimed is:

1. A drawer slide comprising, in combination:

an outer channel for attachment to a wall, said outer channel including an inner end;

an intermediate channel telescopically and slidably mounted in the outer channel and slidable between a closed position and an open position;

an attachment assembly for attaching the intermediate channel to a drawer;

said intermediate channel including an inner end positioned adjacent the inner end of the outer channel when the inner and intermediate channels are in the closed position;

a cushion detent bumper and stop attached to the inner end of the outer channel, said bumper and stop comprised solely of an elastic material and including a central body with at least one separate, resilient leg spaced from the body, projecting in the path of the intermediate channel and flexibly engageable by the intermediate channel when the intermediate channel is moved to the closed position to thereby cushion the movement, said cushion detent bumper and stop further including a separate, integral, resilient cam surface comprised solely of said elastic material and positioned in the path of the intermediate channel;

said inner end of the intermediate channel including a follower face on the inner end which engages with the resilient cam surface of the cushion detent bumper and stop over a range of movement of the intermediate channel to the closed position whereby the resilient leg comprises an integral, elastic, flexible bumper and the cam surface comprises a means to frictionally decrease rebound by intermediate channel movement to the closed position.

2. The slide of claim 1 wherein the bumper comprises first and second resilient arms spaced laterally on opposite sides of the cam surface.

3. The slide of claim 2 wherein the arms are spaced parallel members extending in the direction of intermediate channel movement, said spaced, parallel members being flexibly connected to a main body which is attached to the outer channel.

4. The slide of claim 2 wherein the bumper and stop comprises a central body, first and second flexible connecting limbs extending in opposite directions from the body, each limb in turn being connected with an arm extending in the direction of travel of the intermediate channel in the outer channel and positioned in the pathway of the intermediate channel as it is moved to the closed position.

5. The drawer slide of claims 1 or 4 wherein the attachment assembly includes an inner channel telescopically and slidably mounted in the intermediate channel, said inner channel having an inner end slidable to a closed position at the inner end of the outer channel; and said cushion detent bumper and stop further including an integral, elastic detent member in the path of the inner channel, inner end said inner end of said inner channel including an opening with at least one projecting wing for engagement with the bumper and stop detent member to hold the inner channel in the closed position.

6. The drawer slide of claim 5 wherein said opening includes first and second spaced wings and said detent comprises a detent member projecting in the pathway of both wings.

* * * * *